United States Patent [19]

Keller

[11] Patent Number: 5,054,655

[45] Date of Patent: Oct. 8, 1991

[54] DISPENSING APPARATUS FOR HANDLING CARTRIDGES

[76] Inventor: Wilhelm A. Keller, Riedstrasse 1, CH-6330 Cham, Switzerland

[21] Appl. No.: 319,539

[22] Filed: Mar. 6, 1989

[30] Foreign Application Priority Data

Mar. 7, 1988 [CH] Switzerland ..... 00847/88

[51] Int. Cl.[5] ..... B67D 5/32

[52] U.S. Cl. ..... 222/153; 222/327

[58] Field of Search ..... 222/137, 153, 323–327, 222/334, 389, 63; 227/8

[56] References Cited

U.S. PATENT DOCUMENTS

| | | | |
|---|---|---|---|
| 1,792,656 | 2/1931 | Oakley | 222/63 |
| 2,597,517 | 7/1956 | Wagdy | 227/8 |
| 2,838,210 | 6/1958 | Detrie et al. | 222/327 |
| 4,335,834 | 6/1982 | Zepkin | 222/63 |
| 4,615,469 | 10/1986 | Kishi et al. | 222/327 |
| 4,669,636 | 6/1987 | Miyata | 222/153 |
| 4,731,058 | 3/1988 | Doan | 222/63 X |
| 4,826,053 | 5/1989 | Keller | 222/326 X |
| 4,871,088 | 10/1989 | Cox | 222/326 X |

*Primary Examiner*—Robert P. Olszewski
*Assistant Examiner*—Boris Milef
*Attorney, Agent, or Firm*—Darby & Darby

[57] ABSTRACT

The dispensing apparatus receives and retains disposable cartridges, e.g., dual cartridges for two-component systems. Extensible rams, propelled by auxiliary power (e.g., pneumatic, electric motor power, etc.) are used for advancing the feeder pistons within the cartrdige cylinders for dispensing the cartridge contents. For controlling the auxiliary power the apparatus handle comprises an integrated valve or switch which can be operated with a trigger. If ever the rams should be extended without a cartridge being placed in the discharging position, consequential injuries or damages of material could result therefrom. To prevent this, a cartridge sensing element has been arranged, e.g., for shifting motion within the trigger and provided with a blocking cam. Without a cartridge being in place the cartridge sensing element is held in a blocking or non-actuating position and the blocking cam is positioned facing a stop, thus impeding the operation of the trigger and consequently blocking the extension of the ram. A cartridge placed correctly in the discharging position causes the sensing element to be held in the release position, whereby the blocking cam is freed and thus making triggering of the ram propulsion system possible. Consequently the rams can be extended without hazard in the cartridge cylinders.

3 Claims, 4 Drawing Sheets

DISPENSING APPARATUS FOR HANDLING CARTRIDGES

BACKGROUND OF THE INVENTION

The invention relates to a dispensing apparatus for handling cartridges provided with feeder pistons, the apparatus including retaining means for the exchangeable accommodation of cartridges in a discharge position, and at least one extensible ram driven by auxiliary power for advancing a feeder piston within a cartridge located in the discharge position, and a manually operated triggering member for governing auxiliary power control means.

BACKGROUND OF THE PRIOR ART

Often a dispensing apparatus of this kind, operated by an auxiliary power source, is used for pressing out the contents of cartridges requiring large forces to be exerted by the ram or rams upon the feeder piston or pistons within a cartridge, whereas such forces cannot be conveniently produced manually. This is typically the case with dual cartridges of large size for so called dual component systems, where both components are pressed out from separate cartridge cylinders through a static mixer attached to their orifices. Auxiliary power is usually provided in the form of pressurized media (with pneumatic or hydraulic cylinder/piston units) or electric motor power; accordingly, manually operated control means of the triggering mechanism must include air pressure control valves, electrical switches, etc.

If the triggering mechanism is released deliberately or accidentally (e.g., by playing around) without a cartridge being loaded, i.e., placed in the discharging position, the extensible rams are reaching into empty space within the region of the retaining means, thus becoming freely accessible. As a consequence there exists a risk of a hand getting pinched or injured or causing damage to some object; it is also likely that an improperly positioned cartridge is being squashed and damaged, resulting in spreading around possibly noxious contents.

SUMMARY OF THE INVENTION

It is a primary object of the present invention to provide means for preventing accidental extension of the rams, whenever a correctly inserted cartridge is missing in the discharging position, so as to avoid possible injuries or damages.

In its more specific aspects the present invention relates to a new and improved construction of control mechanisms involving a movably suspended cartridge sensing element exerting influence upon the control of auxiliary power, said element in case of a missing cartridge remaining fixed in its blocking position, and with a properly fitted cartridge in the discharging position it is held in its release position, wherein the release of auxiliary power is inhibited with the sensing element in its blocking position, and wherein power activation is only possible with the sensing element in its release position.

The invention is applicable as well to dispensing apparatuses with one, two or multiple rams (for single, dual or multiple cartridges) independently of the kind of auxiliary power used.

BRIEF DESCRIPTION OF THE DRAWINGS

Subsequently, various embodiments of the dispensing apparatus according to the invention are explained in detail in conjunction with the drawings.

All figures are schematic depictions of partially broken off longitudinal sections along the ram axis of the apparatus.

FIGS. 1 and 2 depict a first example including a cartridge sensing element slidably guided within the release member;

FIGS. 3 and 4 depict a second embodiment in which case the sensing element is formed as a tongue-shaped flat spring; and FIGS. 5 and 6 depict still another embodiment in which case the sensing element is pivotably supported for actuating an auxiliary control member.

DESCRIPTION OF THE PREFERRED EMBODIMENTS

Figure 1:
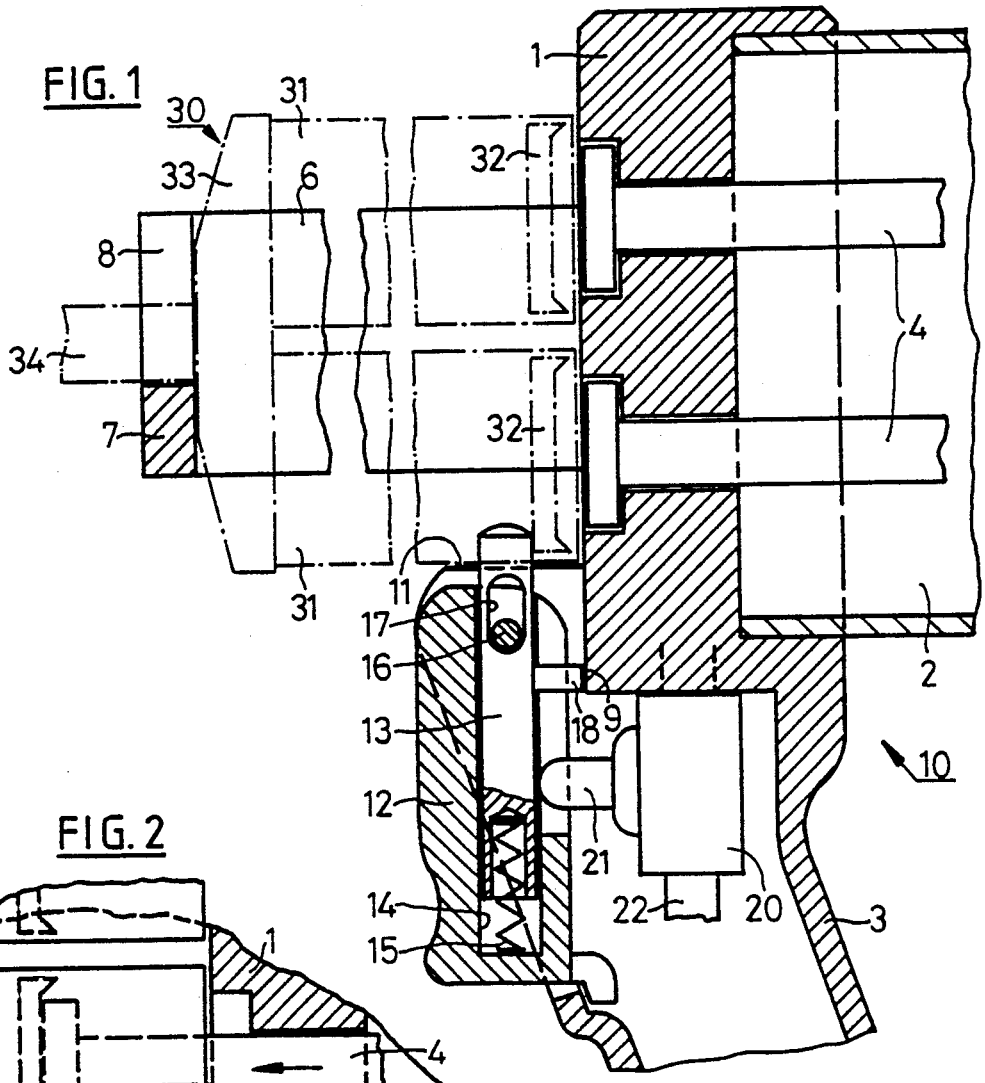
FIGS. 1, 3 and 5 individually depict the situation with the cartridge sensing element in a blocking position, whereas with FIGS. 2, 4 and 6 a cartridge is loaded with the sensing element accordingly located in its release position.

The dispensing apparatus 10 according to FIG. 1 is a device for handling dual cartridges 30, wherefore two extensible rams 4 are arranged in parallel configuration. For a pneumatic, heretofore known propulsion device for the two rams 4, the pneumatic cylinder 2 is only partially depicted; a suitable pneumatic propulsion device is disclosed for example in the published European Patent Application EP A2 No. 0 276 665 by the same applicant. The pneumatic cylinder 2 is held within the head section 1 of the apparatus which also provides guiding for the front end portions of the rams 4. The apparatus 10 is shaped in a pistol-like configuration, including a handle 3, formed integrally with the head section 1. For exchangeably receiving cartridges 30 the dispensing apparatus 10 comprises in-use retaining means, in this particular case in a configuration of two parallel webs 6 which are attached to the head section 1, extending in the direction of the ram axes, and interconnected at the front end (left side FIG. 1) by means of a traversing member 7. A dual cartridge 30 is schematically shown in FIG. 1 with dash-dotted lines. It comprises two storage cylinders 31, containing the components to be discharged, and being closed off at one end by means of a movable feeder piston 32. The other ends of cylinders 31 are joined with an orifice member 33, to which there is affixed a dispensing nozzle 34, e.g., conceived as a tubular static mixer. When a cartridge 30 is correctly inserted from above into the retaining means, the dispensing nozzle 34 lies within a groove 8 of the traversing member 7, whereas the end of the lower cylinder 31 facing the head section 1 is positioned against a stop 11. During the process of inserting or exchanging the cartridges 30, the rams 4 are completely hidden within the head section, as shown in FIG. 1. To press out the cartridge contents, the rams 4 are propelled by the auxiliary power and are extended out of the head section 1, thereby driving the feeder pistons 32 towards the orifice member 33. The resulting forces exerted on the cartridge are absorbed by the traversing member 7, which is in contact with the orifice member 33; it is also conceivable that the cylinders 31 comprise a flange at the ram side, which is detained by means of guiding grooves provided at the head section 1 (not shown).

Figure 2:
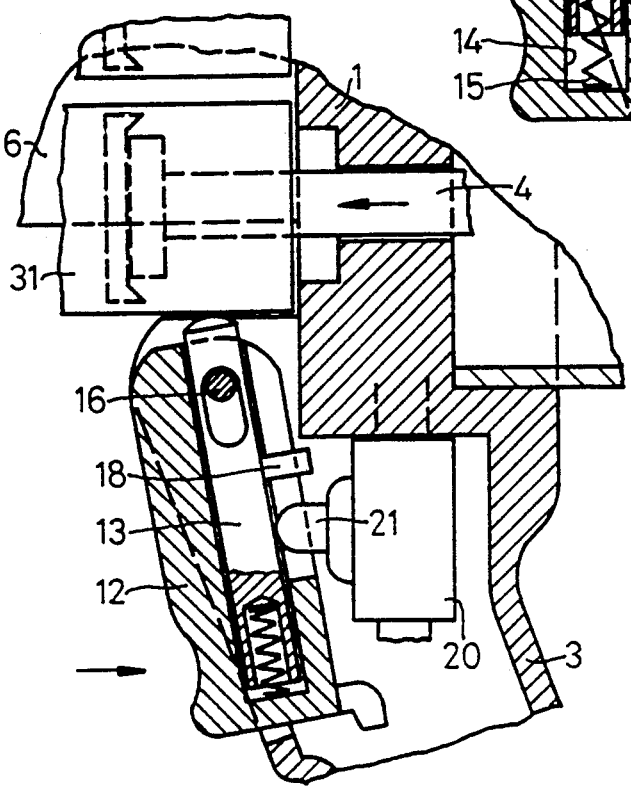

For controlling the auxiliary power for extension of the rams 4 during the discharging process, in this particular case controlling compressed air fed through the pipe line 22, power control means are arranged within the handle 3 comprising a control valve 20 including control tappet 21. The tappet 21 can be manually activated by means of a triggering member 12, e.g., comprising a lever, pivotably supported at the axle 16. To make sure that triggering of the ram propulsion system by means of the pivotable lever 12 is possible only with a cartridge 30 correctly inserted in the discharging position, a movably supported cartridge sensing element (transfer member) is arranged within the area of the cartridge retaining means. In the embodiment of FIGS. 1 and 2, the sensing element is configured as a bolt 13 which is guided for longitudinal sliding within a bore 14 in the pivotable lever 12, the displacement being limited by the length of a slot 17 provided in the sensing element 13, and the pivoting axle 16. Furthermore, a blocking cam 18, is transversely attached to the sensing element 13.

FIG. 1 depicts a situation where no cartridge 30 is placed in the discharging position. Consequently the sensing element 13 is forced into its blocking position by means of a pressure spring 15, whereby it protrudes beyond the stop 11 in the region of the cartridge retaining means. In this blocking position the blocking cam 18 faces a positive stop 9 such that operation of the pivoting lever 12 is inhibited, thus preventing the triggering of the ram propulsion means via the valve 20.

If, however, a cartridge 30 is correctly placed or accommodated in the discharging position, the lower cartridge cylinder 31 transversely displaces the sensing element 13 with respect to the direction of travel of the rams and against the spring 15, and consequently the sensing element 13 is held flush with the stop 11 (FIG. 2). As a consequence, the sensing element 13 assumes its release position, freeing its associated blocking cam 18, thus permitting movement of the pivotable lever 12 in the direction of the arrow (against a normally used resetting spring, not shown). Thus, releasing the auxiliary power and consequent extension of the rams 4 is only possible with a cartridge properly placed in the discharging position, holding the sensing element 13 in its release position. Therefore, extension of the rams from the head section 1 takes place under total protection and without risk inside the cartridge cylinders 31 (FIG. 2).

Figure 3:
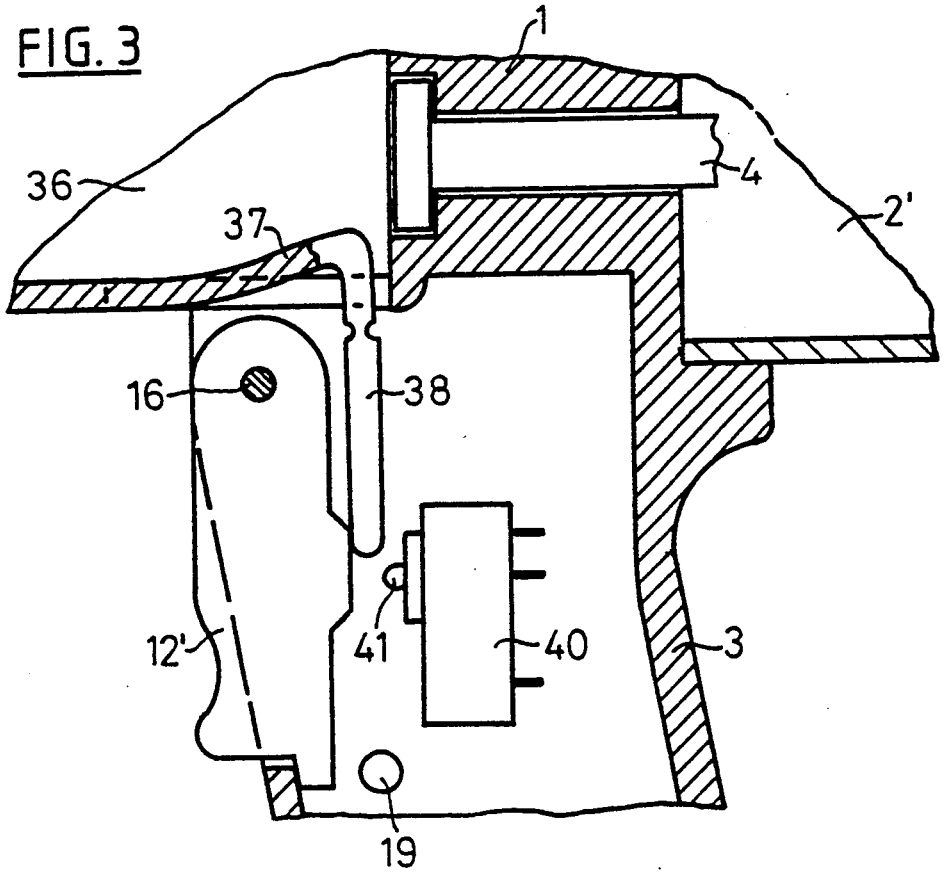
Figure 4:
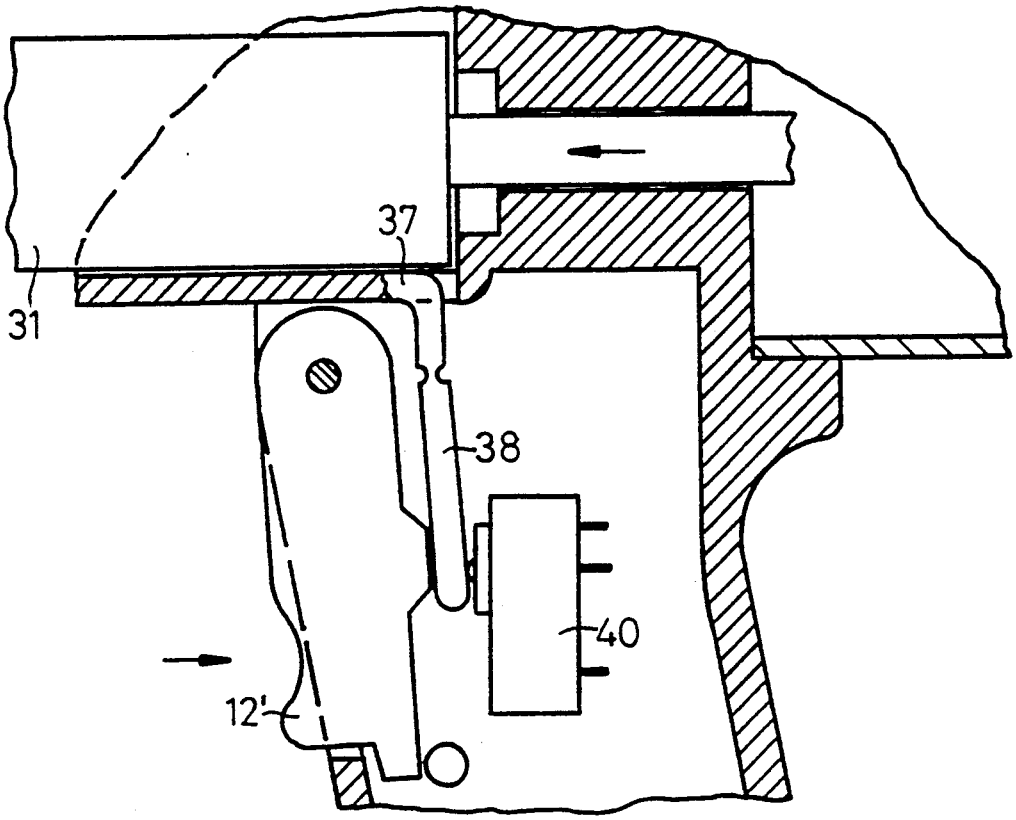

With the embodiment according to FIGS. 3 and 4, essential parts of the dispensing apparatus are arranged similarly and therefore are assigned similar reference numbers in correspondence with the previous example. In this case, however, an electric motor propulsion system is being assumed for the extension of one or more rams 4; such a propulsion unit, located within a housing 2', is not herein further illustrated. For controlling the electrical propulsion unit a switch 40, comprising a releasing tappet 41 is arranged within the handle 3. The retaining means for receiving the cartridges in this case is conceived as a trough 36, of which only the lower section adjoining to the head section 1 is being depicted.

Deviating from the previous example as well, the cartridge sensing element is shaped in a tongue-like configuration 37 and is resiliently movable transversely to the direction of travel of the ram. As illustrated, the tongue 37 may be integrally formed at the base of the plastic trough 36. A transfer member 38 provided at the tongue 37 is displaceable jointly with the tongue. According to FIG. 3, the sensing element 37, together with the transfer member, assumes a blocking position, i.e., the sensing element 37 protrudes upwards, as caused by spring action from the base of the through 36, because there is no cartridge positioned within the apparatus. However, the pivotable lever 12' is operable as far as a stop 19 (against a resetting spring, which is not shown), whereas this action remains ineffective, since the release lever 12 cannot reach the tappet 41 of switch 40.

A properly inserted cartridge accommodated within the retaining means (cylinder 31, FIG. 4), however, presses the sensing element 37 downward. Thus it is maintained in its release position, whereby the transfer member 38 is located between the lever 12' and the switching tappet 41. If now the pivotable lever 12' is being moved in the direction of the arrow (FIG. 4), the switch 40 becomes actuated via the transfer member 38.

Figure 7:
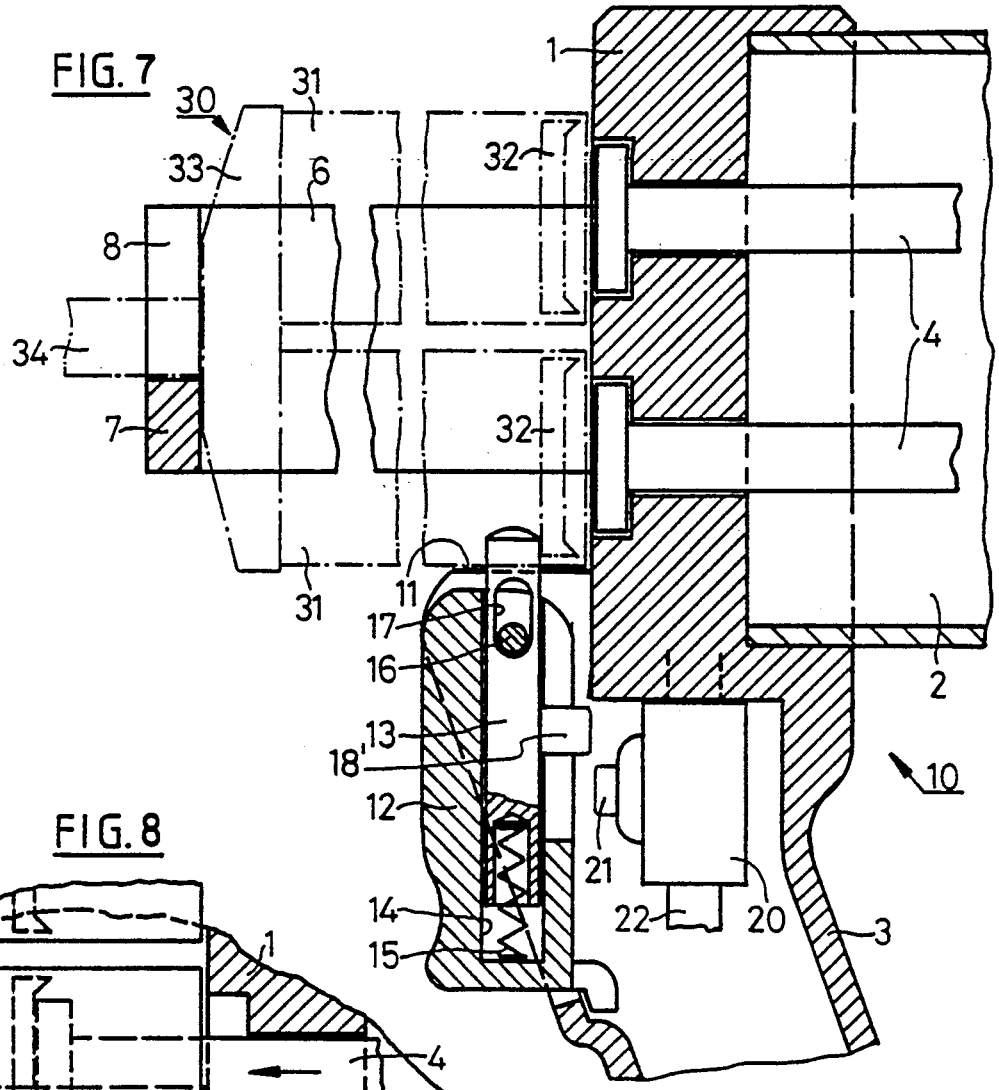
FIGS. 7 and 8 depict an alternative embodiment, similar to FIGS. 1 and 2, with a cartridge sensing element slidably guided within the release member.
Figure 8:
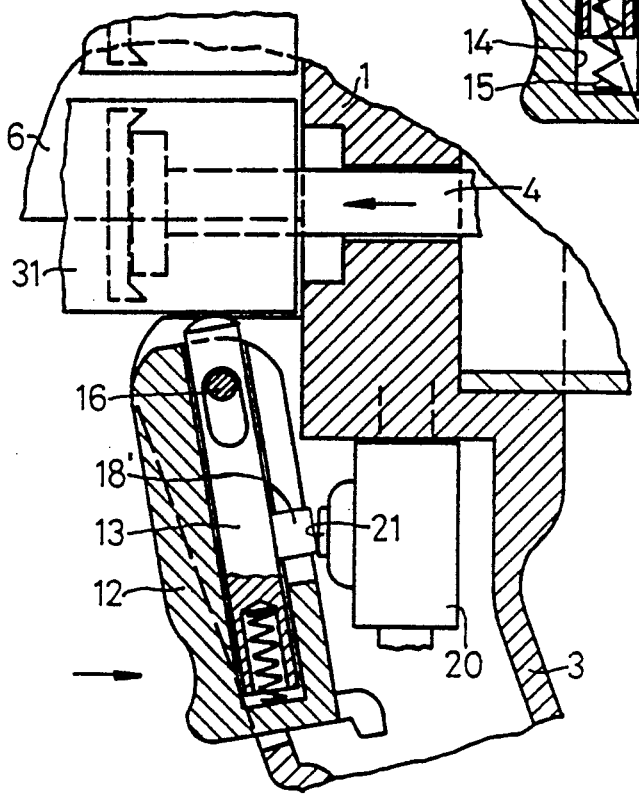

For the embodiment according to FIGS. 1 and 2, it is also conceivable of course to attach a transfer member to the sensing element 13 (e.g., shaped as a ramp or a cam), instead of a blocking cam 18 cooperating with a positive stop 9, whereas such a transfer member can only reach the valve tappet 21 while the sensing element is in its release position. This construction is illustrated in FIGS. 7, 8, wherein a transfer member 18' is positioned where it cannot actuate the valve tappet 21 when no cartridge is present, even when the trigger lever 12 is pivoted (FIG. 7). As illustrated in FIG. 8, when a cartridge is present, the transfer member 18' is moved into position opposing the tappet 21. When the lever 12 is pivoted as illustrated, the transfer lever 18' pushes against the tappet 21 to actuate the device.

Figure 5:
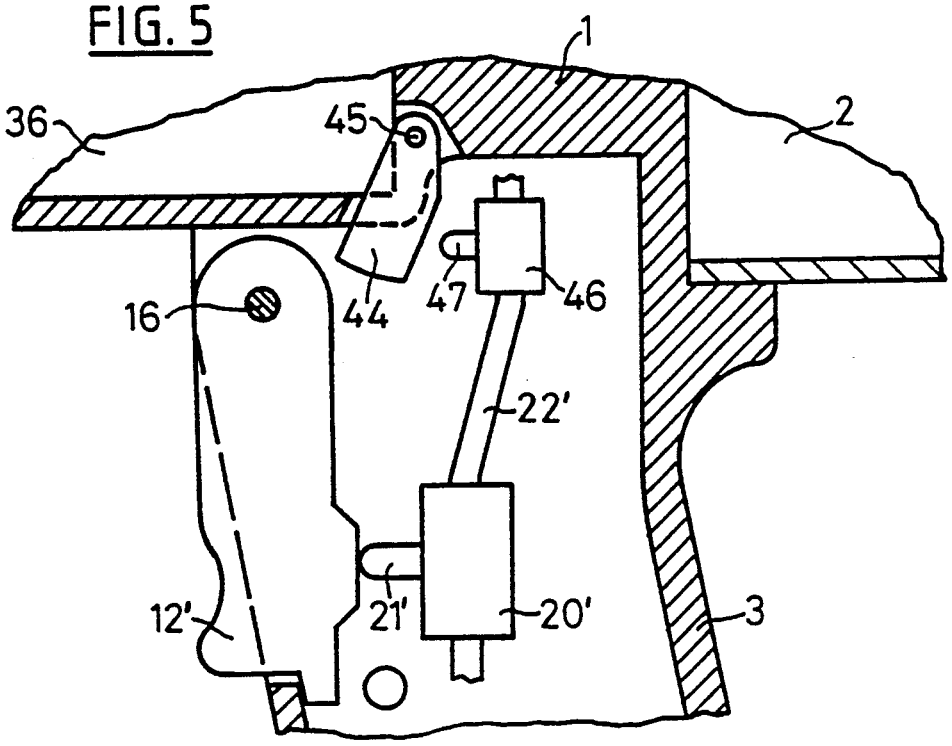
Figure 6:
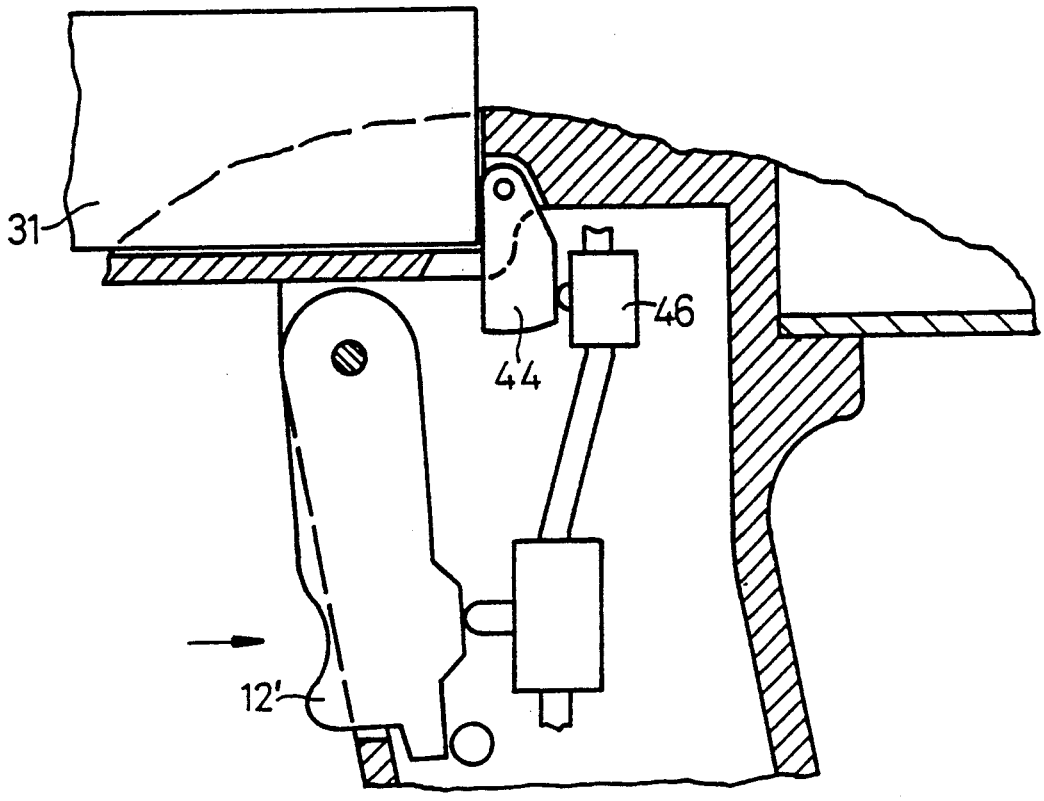

The embodiment according to FIGS. 5 and 6 again differs from the previously shown embodiments in the configuration of the sensing element and the method of action upon the control means for the auxiliary power. As a sensing element, a pivotable cam 44 is arranged which is pivotably supported by an axle 45 within the area of a lower corner of the cartridge retaining trough 36. This sensing element 44 is acting in conjunction with an auxiliary valve 46, 47 (under the assumption of pneumatic propulsion of the ram or rams 4). The auxiliary valve 46 is interconnected with the main valve 20', of which the tappet 21' is manually actuated by the trigger 12'. In case of a missing cartridge (FIG. 5), the sensing element is maintained in its blocking position by means of a resetting spring, not shown, whereby it is protruding into the trough 36; the auxiliary valve 46 in this case cannot be actuated and therefore shuts off the compressed air line 22'. The trigger 12', however, can be moved as well with the sensing element 44 being in the blocking position, nevertheless this will remain ineffective due to the blocking action of the auxiliary valve 46. A correctly inserted cartridge (cylinder 31, FIG. 6) will displace the sensing element 44 out of the through 36 and hold it in its release position, thus actuating the auxiliary valve 46. In this situation, actuation of the lever 12' initiates the desired motion of the ram.

As a matter of fact, the herein described variations of safety measures for preventing accidental extension of the ram can be deliberately disabled when no cartridge is inserted, e.g., by manually moving the sensing element to its release position and at the same time using the other hand to actuate the trigger 12. This, however, represents a knowingly, willful bypassing or "overriding" of the herein provided safety members. In this connection, it is of advantage to have the cartridge sensing element arranged within an initial range or portion of the ram's extension path, as is the case for all examples specified. In this case the bypassing of safety measures is limited to a short, relatively harmless initial portion of the ram's extension path, whereupon the sensing element is getting covered by the moving rams immediately afterwards, rendering it essentially inaccessible.

While there are shown and described present preferred embodiments of the invention, it is to be distinctly understood that the invention is not limited thereto, but may be otherwise variously embodied and practised within the scope of the following claims. Accordingly,

What I claim is:

1. A dispensing apparatus for actuation by auxiliary power means and for handling cartridges having feeder pistons, said apparatus comprising:

retaining means for the exchangeable insertion and retention of said cartridges in a discharging position;

at least one extensible ram subject to actuation by said auxiliary power means for feeder piston advancement within each said cartridge located in said discharging position;

control means controlling said auxiliary power means;

a manually operated triggering member for actuating said control means, said control means including a movably supported cartridge sensing element, said sensing element being subject to movement between a first position and a second position, in said first position of said sensing element, said triggering member being able to actuate said control means, and in said second position of said sensing element, said triggering member being blocked from actuating said control means, said sensing element being placed in said first position by proper insertion of a cartridge into said retaining means, said sensing element being guided within a bore inside said triggering member for essentially transverse motion with respect to the direction of travel of said ram;

and means for maintaining said sensing element in said second position when said cartridge is not retained in said retaining means, no actuation of said control means being possible when said cartridge is not present in said apparatus, actuation being possible only with said cartridge in said retaining means, said means for maintaining said sensing element in said second position including a spring urging said sensing element towards its blocking position.

2. The dispensing apparatus as defined in claim 1, wherein said sensing element further comprises a blocking cam, operation of the triggering member being inhibited by contact of said cam with a fixed portion of said apparatus with the sensing element positioned in its blocking position.

3. The dispensing apparatus as defined in claims 1, wherein said sensing element comprises a transfer member, which only in said first position of the sensing element transfers a motion of said triggering member to said auxiliary power control means.

* * * * *

UNITED STATES PATENT AND TRADEMARK OFFICE

CERTIFICATE OF CORRECTION

PATENT NO. : 5054655

DATED : October 8, 1991

INVENTOR(S) : W. KELLER

It is certified that error appears in the above-identified patent and that said Letters Patent is hereby corrected as shown below:

On the title page, in item (76) inventor:

Inventor's Address is as follows:

Grundstrasse 12
CH-6343 Rotkreuz
SWITZERLAND

Signed and Sealed this

Second Day of March, 1993

*Attest:*

STEPHEN G. KUNIN

*Attesting Officer*

*Acting Commissioner of Patents and Trademarks*